United States Patent [19]

Wood, Jr.

[11] Patent Number: 4,944,424

[45] Date of Patent: Jul. 31, 1990

[54] SAFETY CAP ASSEMBLY

[76] Inventor: Theodore N. Wood, Jr., Pole 257, R.D. 3, Box 121, Harvey's Lake, Pa. 18618

[21] Appl. No.: 462,468

[22] Filed: Jan. 9, 1990

[51] Int. Cl.[5] ..... B65D 25/00

[52] U.S. Cl. ..... 220/85 P; 220/326; 137/382

[58] Field of Search ..... 220/85 P, 210, 246, 220/248, 284, 323, 326; 137/382

[56] References Cited

U.S. PATENT DOCUMENTS

| | | | |
|---|---|---|---|
| 3,372,836 | 3/1968 | Smith | 220/85 P |
| 4,332,331 | 6/1982 | Fawley | 137/382 X |
| 4,341,436 | 7/1982 | Kanno et al. | 220/326 X |
| 4,648,526 | 3/1987 | Wood, Jr. | 220/85 P |
| 4,651,888 | 3/1987 | Wood, Jr. | 220/85 P |
| 4,678,003 | 7/1987 | Griffin | 220/85 P X |
| 4,880,134 | 11/1989 | Wood, Jr. | 220/85 P |

*Primary Examiner*—Steven M. Pollard
*Attorney, Agent, or Firm*—Bacon & Thomas

[57] ABSTRACT

The valved discharge opening of a cylinder containing pressurized fluid is protected by a safety cap assembly including a dome-shaped cap that is detachably secured to a collar which is in turn threadedly engaged with the existing threaded cap ring flange of the cylinder. The collar is provided with a pair of locking tabs which are spring-biased to extend outwardly through a pair of opposed circumferential slots formed in the collar for locking engagement through a pair of corresponding opposed circumferential slots formed in the cap. The cap and collar further include cooperating recesses for water drainage, an aperture formed in one locking tab to permit the attachment of a wire seal, and a passageway extending transversely through the sidewall of the collar for receiving a punch to deform the thread inwardly to lock the collar to the ring cap flange.

12 Claims, 3 Drawing Sheets

SAFETY CAP ASSEMBLY

BACKGROUND OF THE INVENTION

1. Field of the Invention

The present invention relates to the field of technology pertaining to caps for protecting valved discharge openings of pressurized fluid cylinders during handling and transporting of the cylinders. More specifically, the invention relates to an improved safety cap assembly for attachment to the existing threaded cap ring flange of a pressurized cylinder.

2. Description of the Prior Art

Conventional metal cylinders for containing certain fluids, such as oxygen and flammable gases, under highly pressurized conditions are provided with some form of cap means for enclosing and protecting the valved discharge opening of the cylinder from being accidentally ruptured when the cylinder is handled and transported. Because the fluid contained within the cylinder is highly pressurized and often flammable, accidental rupturing of the cylinder valve from severe impact poses a serious potential for physical injury to personnel and property damage. Because of this situation, minimum industrial safety standards have been established for such caps in order to assure their reliability under anticipated normal conditions of use. Typically, such caps are formed of steel in order to withstand the constant impacting and rough handling to which they are normally subjected during handling and transporting of the cylinders.

It is well known to provide safety caps for pressurized cylinders in the form of a dome-shaped cap member having a threaded internal wall portion which permits the cap to be threadedly engaged onto a existing threaded cap ring flange secured to a pressurized cylinder. Attachment and removal of a cap having a threaded coupling of this type is time consuming. Moreover, the threaded engagement often rusts and corrodes, particularly when the cylinders are used in corrosive environments. A threaded coupling may also become distorted in the event the cap is subjected to a severe impact, thereby making the cap very difficult to remove from the cylinder. Under such circumstances, it is not uncommon for an operator to attempt to release a cap having a corroded or distorted threaded coupling by striking the cap, thereby further posing the danger of rupturing the valve of the discharge opening.

In order to overcome the aforementioned problems with a threaded coupling for the safety cap of a pressurized cylinder, there have been many attempts to provide alternative forms of coupling mechanisms wherein the cap may be detachably secured to the cylinder without requiring a direct threaded engagement between the cap and cylinder. For example, it is known to provide a mechanism in the form of ring which is first threadedly engaged onto the existing cap ring flange of the cylinder and thereafter detachably engage the cap to the ring through a correspondingly configured interlock between the cap and ring. The use of tabs, latches and bayonet type couplings between the cap and a portion of the cylinder are also well known. However, though mechanisms of this type do overcome the inherent problems associated with threaded couplings, they nevertheless do have other disadvantages. For example, nonthreaded coupling mechanisms are often quite complex and expensive to manufacture. They are also difficult to manipulate and often do not provide absolute security against accidental dislodgment of the cap during normal use.

SUMMARY OF THE INVENTION

It is an object of the present invention to provide an improved safety cap assembly for the valved discharge opening of a cylinder for containing pressurized fluids.

It is another object of the invention to provide an improved safety cap assembly for a pressurized cylinder wherein the cap may be easily and quickly attached to the cylinder for enclosing and protecting the valved discharge opening, and removed from the cylinder for gaining access to the valve.

It is a further object of the invention to provide a safety cap assembly for a pressurized cylinder wherein the assembly is of simple construction and economical to manufacture.

It is yet another object of the invention to provide a safety cap assembly for the valved discharge opening of a pressurized cylinder wherein the cap may be detachably secured to the cylinder against accidental removal during all conditions of normal use.

These and other objects of the invention are realized by providing a safety cap assembly which includes a dome-shaped cap and an associated collar, the latter having an internal threaded portion for threaded engagement to the existing threaded cap ring flange of a conventional pressurized cylinder. The cap includes a cylindrical-shaped open end and a pair of circumferential slots provided in opposed wall portions thereof. The collar is of corresponding cylindrical configuration, slidably receivable within the open end of the cap and also provided with a pair of corresponding circumferential slots in opposed wall portions thereof. A pair of locking tabs are carried by the collar and spring-biased to extend radially outwardly through the slots thereof. The slots in the cap are alignable with the corresponding slots in the collar so that when the collar is received within the cap, the locking tabs may also extend through the slots of the cap to detachably secure same to the collar.

The open end of the cap may be provided with a flared skirt for engaging the outer edges of the locking tabs so that the cap may be snap fitted onto the collar by axially sliding the cap onto the collar, urging the tabs inwardly and thereafter permitting the tabs to automatically extend radially outwardly through the corresponding slots in the cap. Alternatively, the cap may be axially slid onto the collar in a random position by manually urging the tabs inwardly to permit the cap to slide thereover, and thereafter rotating the ca in either direction to align the slots thereof with those of the collar and permit the locking tabs to snap therethrough.

The cap assembly may also be provided with water discharge means, means for facilitating the attachment of a tamper evidencing seal and means for locking the collar to the threaded cap ring flange of the cylinder.

Other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

Figure 1:
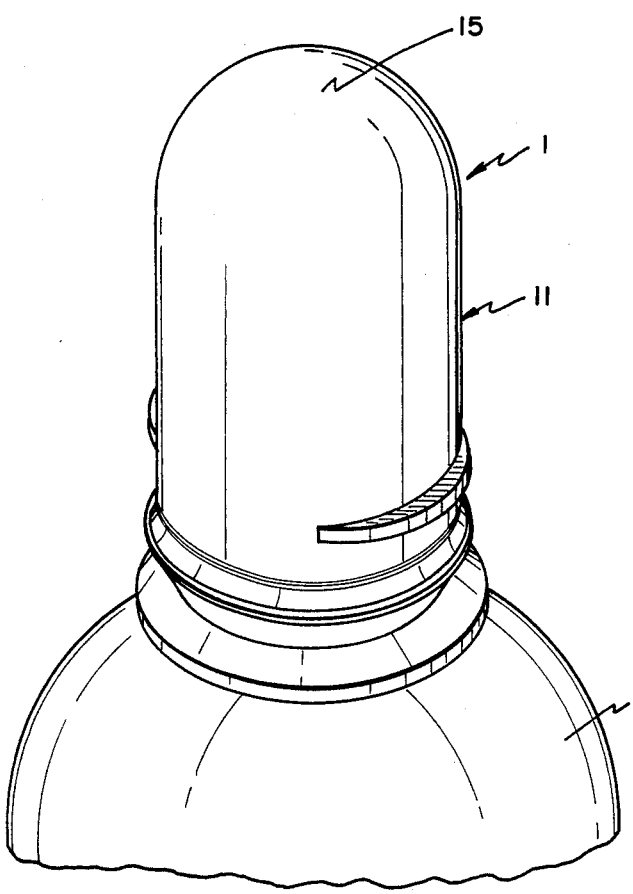
FIG. 1 is a partial perspective view showing a safety cap assembly, according to a preferred embodiment of the invention, attached to the existing threaded cap ring flange of a conventional cylinder for containing pressurized fluid.
Figure 2:
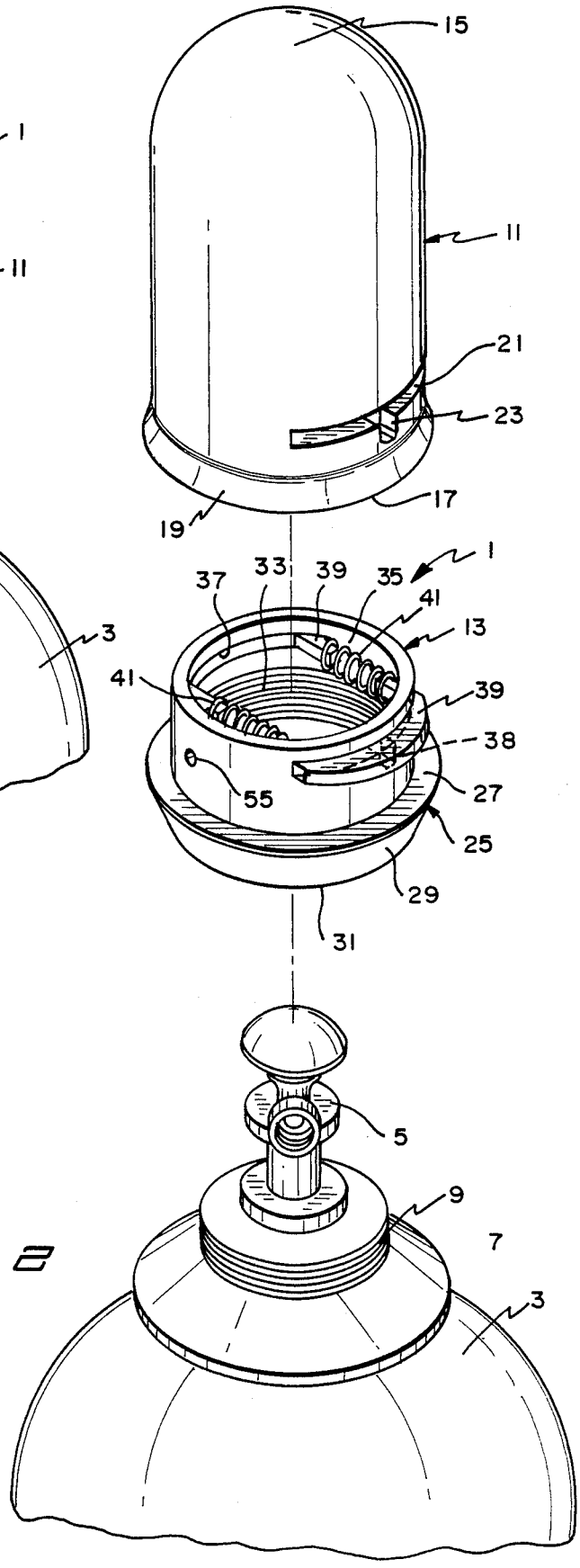
FIG. 2 is a partial exploded perspective view showing the cap and collar forming the safety cap assembly, the manner of threaded engagement between the collar and threaded cap ring flange, and the existing valve at the discharge opening of the cylinder.

A safety cap assembly 1 according to a preferred embodiment of the invention shall be described with initial reference to FIGS. 1 and 2. As seen in FIG. 1., assembly 1 is depicted in its position of attachment on the existing valved discharge opening of a cylinder 3 used to contain a pressurized fluid, such as oxygen, flammable gases or the like. Cylinder 3 is of conventional construction and is normally formed of steel.

With reference to FIG. 2, the valved discharge opening of cylinder 3 is also of conventional construction and essentially includes a valve 5 and a cap ring flange 7, the latter being provided with a threaded portion 9. As apparent, the valved discharge opening of cylinder 3, if left exposed, becomes vulnerable to possible rupturing of valve 5 from severe impact during handling and transporting of cylinder 3. Assembly 1 of the invention is provided to protect the valved discharge opening and includes, as its basic components, a cap 11 and an associated collar 13. Both cap 11 and collar 13 are also preferably formed of steel or any other suitable material having substantially the same hardness and strength characteristics for withstanding the type of severe impacts normally sustained during conventional handling and transporting of cylinder 3.

As further apparent from FIG. 2, cap 11 is substantially of hollow cylindrical shape and includes a dome-shaped top end 15 and an open bottom end 17. It is preferred that bottom end 17 be partially defined by a circumferential outwardly flared skirt 19. A pair of circumferential slots 21 are formed in opposed wall portions of cap 11. A downwardly extending recess 23 is preferably provided in the midpoint vicinity of one slot 21 for discharging water collected within assembly 1.

Collar 13 is of a corresponding cylindrical shape and has an outer diameter corresponding substantially to but slightly smaller than the inner diameter of cap 11 so that collar 13 may be axially and rotatably received therein. The lower portion of collar 13 includes an outwardly extending base portion 25 having an annular upper face 27, an inwardly and downwardly tapered side wall 29 and an annular bottom face 31. Collar 13 further includes a threaded portion 33 formed on an internal wall 35 thereof, with threaded portion 33 corresponding to threaded portion 9 of cap ring flange 7 so that collar 13 may be threadedly coupled to flange 7. A pair of circumferential slots 37 are provided in opposed wall portions of collar 13, with slots 37 corresponding in size and configuration to slots 21 of cap 11. Moreover, the circumferential locations of slots 21 and 37 permit their alignment when collar 13 is received within cap 11 and bottom end 17 of cap 11 is disposed in abutting engagement against upper face 27 of collar 13. One slot 37 of collar 13 is also provided with a downwardly extending recess 38 for corresponding alignment with recess 23 of slot 21.

Figure 3:
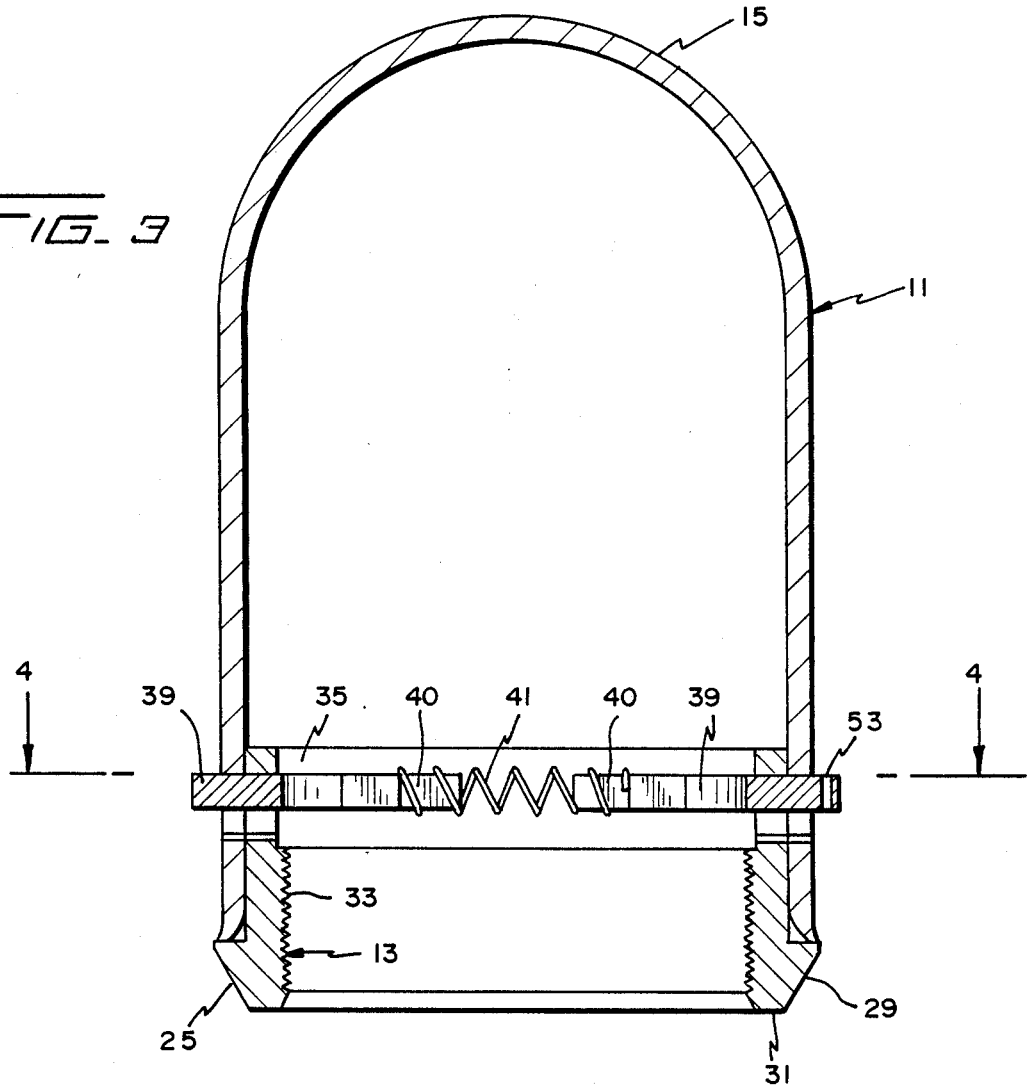
FIG. 3 is an elevational cross sectional view of the safety cap assembly showing the cap in its position of attachment on the collar and the manner in which the locking tabs of the collar detachably secure the cap to the collar.
Figure 4:
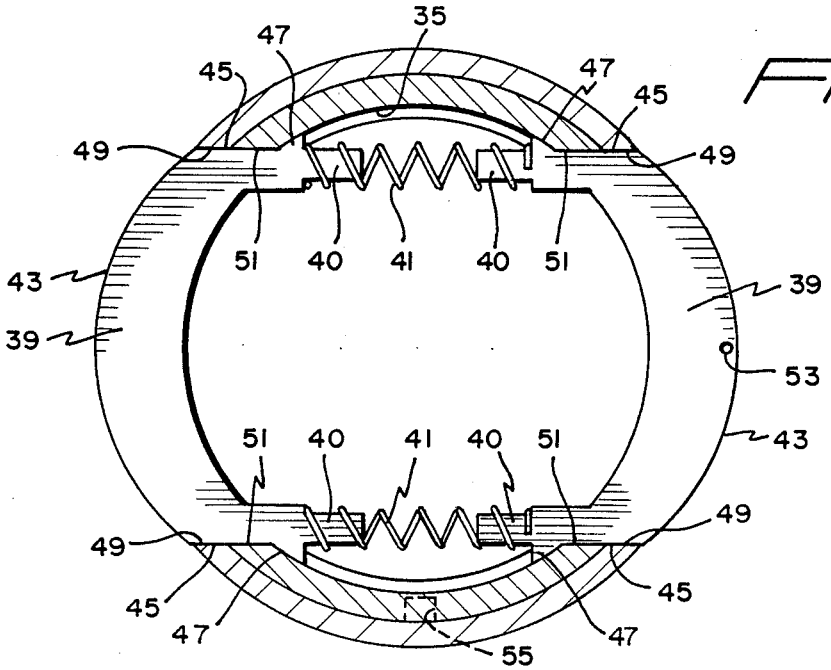
FIG. 4 is a cross sectional view taken along the line 4—4 of FIG. 3.

A pair of locking tabs 39 having two pairs of inwardly extending stubs 40 are provided in collar 13 and are biased by a pair of coil springs 41 engaging stubs 40 to extend outwardly through slots 37. Since slots 21 of cap 11 are alignable with slots 37 of collar 13, such alignment shall permit locking tabs 39 to also extend radially outwardly through slots 21 for the purpose of detachably securing cap 11 to collar 13. This is shown in FIGS. 3 and 4. In this position of attachment, bottom end of cap 11 is disposed in engagement against upper face 27 of collar 13, thereby disposing slots 21 and 37 in vertical alignment. When horizontal alignment between slots 21 and 37 are also realized, locking tabs 39 are urged radially outwardly under the bias of springs 41 and extend through each corresponding pair of slots 21 and 33, thereby preventing both axial and rotational movement of cap 11 relative to collar 13.

As more particularly seen in FIG. 4, locking tabs 39 are preferably of the same arcuate configuration, with each tab 39 including a curved outer wall 43 and a pair of parallel outer side walls 45. Each side wall 45 extends rearwardly and terminates in an outwardly curved section 47, the curvature of which corresponds to the curvature of internal wall 35 of collar 13. Each slot 21 includes a pair of opposed vertical walls 49 and each slot 37 includes a pair of corresponding opposed vertical walls 51. As apparent in FIG. 4, when corresponding pairs of slots 21 and 35 are disposed in vertical and horizontal alignment, each pair of adjacent vertical walls 49 and 51 are disposed in adjacent parallel relationship with a corresponding side wall 45 of tab 39. This also places each curved section 47 in abutting relationship against inner wall 35, thereby limiting the outward extension of tabs 39. The curvature of outer wall 43 of each tab 39 should be such that the midportion of outer wall 43 is disposed sufficiently outwardly of the exterior surface of cap 11, as shown in FIG. 3, to permit manual or tool engagement of outer wall 43 for urging each tab 39 inwardly against the bias of springs 41. As further seen in FIG. 4, at least one tab 39 may be provided with a transverse aperture 53 therethrough for receiving a tamper evidencing means, such as a wire seal, to indicate unauthorized removal of cap 11 from collar 13.

As also shown in FIGS. 2 and 4, collar 13 may be provided with a transverse passageway 55 extending from its outer wall inwardly and terminating short of threaded portion 33. Passageway 55 is sized and configured for receiving the end of a conventional punch tool so that threaded portion 33 may be deformed inwardly against threaded portion 9 of cap ring flange 7 for the purpose of locking collar 13 to cap ring flange 7. It is preferred that passageway 55 be circumferentially offset by approximately 90° from the midpoint between vertical side walls 51 of each slot 37.

Figure 5:
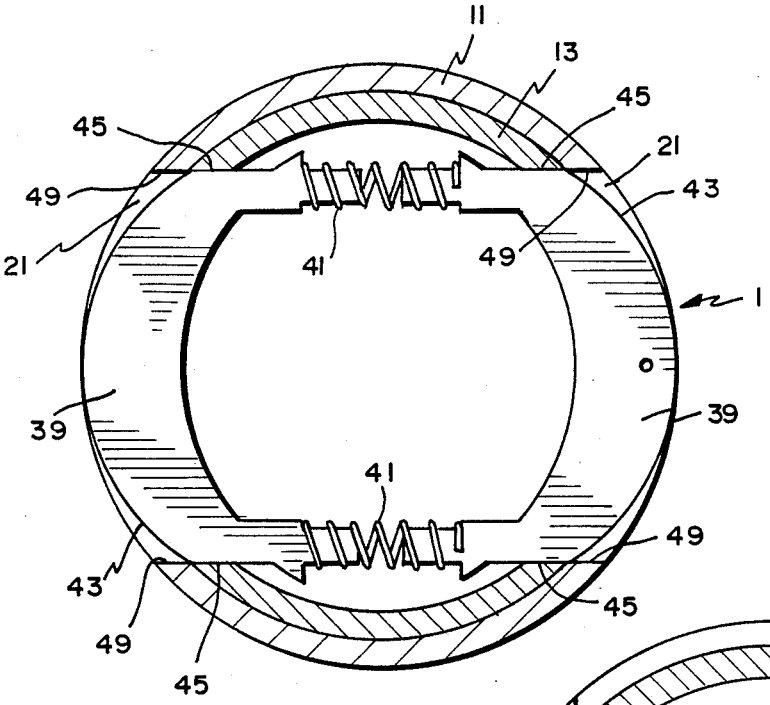
FIG. 5 is a cross sectional view similar to that shown in FIG. 4 but depicted with the locking tabs urged inwardly a sufficient distance to permit the cap to be rotated relative to the collar.
Figure 6:
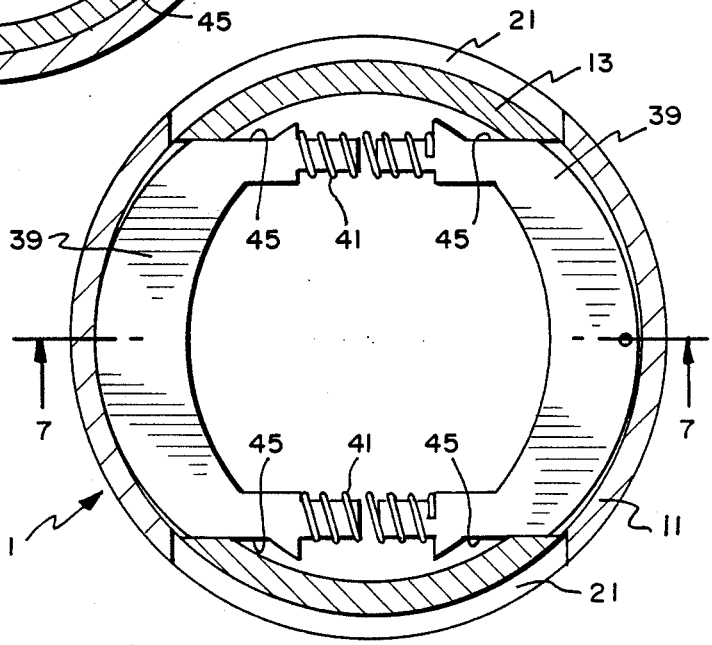
FIG. 6 is a cross sectional view similar to FIG. 5 but shown with the cap rotated approximately 90° to remove the slots thereof completely out of alignment with the corresponding slots of the collar and urge the locking tabs fully inwardly to permit removal of the cap from the collar in an axial direction.
Figure 7:
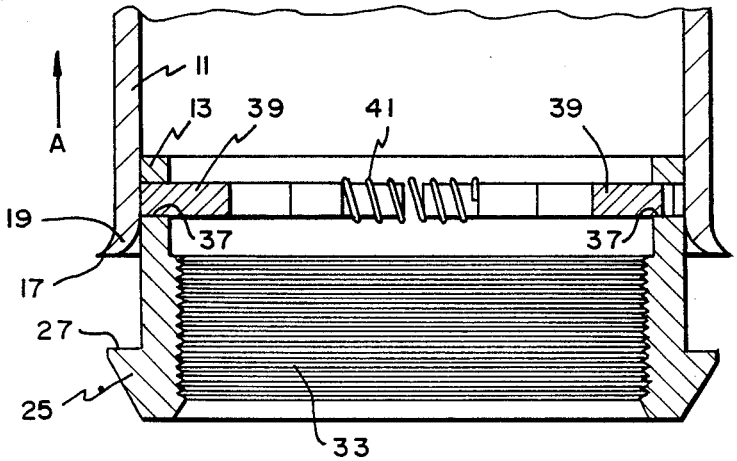
FIG. 7 is a cross sectional view taken along the line 7—7 of FIG. 6.

The manner in which cap 11 is attached to or removed from collar 13 shall now be described with reference to FIGS. 5–7. As first seen in FIG. 5, locking tabs 39 are shown urged inwardly to a point where the outer end portions of curved walls 43 are aligned and form a smooth transition junction with adjacent exterior wall portions of collar 13, wherein such outer end portions and exterior wall portions are defined by substantially the same radius of curvature. In this position, sidewalls 45 of tabs 39 are moved away from vertical walls 49 of slots 21. Cap 11 is therefore permitted to rotate with respect to collar 13, which rotation further serves to urge tabs 39 radially inwardly against the bias of springs 41. As seen in FIG. 6, cap 11 has been rotated approximately 90° from its original position shown in FIG. 5, thus disposing slots 21 completely out of alignment with slots 37. In this position, cap 1 may be axially moved away from collar 13 and in the direction of arrow A as indicated in FIG. 7. Upon complete removal of cap 11 from collar 13, tabs 39 are permitted to again extend radially outwardly through slot 37 under the bias of springs 41 to the position previously shown in FIG. 4.

Attachment of cap 11 to collar 13 is facilitated by the presence of flared skirt 19. Cap 11 is merely placed over collar 13 and moved axially to receive collar 13 therein. Skirt 19 extends over the outermost midpoint portions of curved walls 43 of locking tabs 39, thereby automatically urging tabs 39 inwardly. This permits collar 13 to be fully received within cap 11 and dispose bottom end 17 in abutting engagement against upper face 27. If slots 21 of cap 11 are in horizontal alignment with slots 37 of collar 13, then tabs 39 shall automatically extend through slots 21 to secure cap 11 in place. If this alignment is not initially realized, then it is only required to simply rotate cap 21 to place slots 21 and 37 in alignment, thereby automatically permitting tabs 39 to snap-fit through slots 21. Removal of cap 11, as previously described, only requires urging tabs 39 inwardly to the minimum extent shown in FIG. 5, thereby permitting rotation of cap 11 relative to collar 13 and its detachment therefrom.

It is to be understood that the present invention has been described herein in connection with a preferred embodiment thereof, and that it shall be apparent to those skilled in the art that modifications, additions, substitutions and deletions may be made without departing from the spirit of the invention or scope of the subjoined claims.

I claim:

1. A safety cap assembly for protecting the valved discharge end of a pressurized cylinder provided with an existing threaded cap ring flange, which assembly comprises:

(a) a cap including a cylindrical-shaped open bottom end and a first pair of circumferential slots formed in opposed wall portions thereof;

(b) a cylindrical-shaped collar including a second pair of circumferential slots formed in opposed wall portions thereof and an internal threaded wall portion for threaded engagement with a threaded cap ring flange of a pressurized cylinder;

(c) a pair of locking tabs carried by the collar and spring means biasing the tabs outwardly through the second pair of slots; and (d) the collar being slidably and rotatably receivable within the open end of the cap to position the first and second pairs of slots in alignment and permit the locking tabs to extend through the first pair of slots and detachably secure the cap to the collar.

2. The safety cap assembly of claim 1 wherein each locking tab includes a pair of inwardly extending stubs, the spring means includes a pair of coil springs, and each coil spring being disposed in engagement with a stub of each locking tab.

3. The safety cap assembly of claim 1 wherein the collar includes an outwardly extending base portion having an annular upper face, and the bottom end of the cap being disposable in abutting engagement with the upper face when the locking tabs extend through the first pair of slots.

4. The safety cap assembly of claim 1 wherein each locking tab includes a curved outer wall having outer end portions defined by a radius of curvature corresponding substantially to the radius of curvature of adjacent exterior wall portions of the collar s that when the tabs are urged inwardly against the spring bias, the outer end portions and adjacent exterior wall portions form sufficiently smooth transition junctions to permit rotation of the cap relative to the collar for urging the locking tabs inwardly and permitting removal of the cap from the collar.

5. The safety cap assembly of claim 1 further including means for locking the collar to the threaded cap ring flange.

6. The safety cap assembly of claim 5 wherein the locking means includes a passageway extending transversely through the wall of the collar and terminating short of the threaded wall portion for receiving a punch to deform the threaded wall portion inwardly against the threaded cap ring flange.

7. The safety cap assembly of claim 1 further including means for evidencing unauthorized removal of the cap from the collar.

8. The safety cap assembly of claim 7 wherein the means for evidencing unauthorized removal includes a transverse passageway extending through a portion of at least one locking tab for receiving a wire seal.

9. The safety cap assembly of claim 1 further including water drainage means.

10. The safety cap assembly of claim 9 wherein the water drainage means includes corresponding recess means formed in the cap and the collar.

11. The safety cap assembly of claim 10 wherein the corresponding recess means includes a downwardly extending recess formed at each bottom edge of corresponding first and second slots.

12. The safety cap assembly of claim 1 wherein the bottom end of the cap further includes an outwardly flared skirt for engaging and urging the locking tabs inwardly when the cap is moved axially into sliding engagement with the collar.

* * * * *